US010632493B2

(12) United States Patent
Rajala

(10) Patent No.: US 10,632,493 B2
(45) Date of Patent: Apr. 28, 2020

(54) ADHESIVE APPLICATOR WITH ROTARY VALVE

(71) Applicant: Kimberly-Clark Worldwide, Inc., Neenah, WI (US)

(72) Inventor: Gregory J. Rajala, Neenah, WI (US)

(73) Assignee: KIMBERLY-CLARK WORLDWIDE, INC., Neenah, WI (US)

( * ) Notice: Subject to any disclaimer, the term of this patent is extended or adjusted under 35 U.S.C. 154(b) by 0 days.

(21) Appl. No.: 15/757,943

(22) PCT Filed: Sep. 29, 2015

(86) PCT No.: PCT/US2015/052919

§ 371 (c)(1),
(2) Date: Mar. 6, 2018

(87) PCT Pub. No.: WO2017/058170

PCT Pub. Date: Apr. 6, 2017

(65) Prior Publication Data

US 2018/0345309 A1 Dec. 6, 2018

(51) Int. Cl.
*B05C 5/02* (2006.01)
*B05C 11/10* (2006.01)

(52) U.S. Cl.
CPC ..... *B05C 5/0233* (2013.01); *B05C 5/025* (2013.01); *B05C 5/0212* (2013.01); *B05C 5/0254* (2013.01); *B05C 11/1042* (2013.01)

(58) Field of Classification Search
USPC ..... 118/313–315, 325, 300, 410, 416, 301
See application file for complete search history.

(56) References Cited

U.S. PATENT DOCUMENTS

| | | | |
|---|---|---|---|
| 3,419,934 | A | 1/1969 | Lovett |
| 4,281,619 | A | 8/1981 | Frick |
| 4,293,367 | A | 10/1981 | Klasek |
| 4,675,068 | A | 6/1987 | Lundmark |
| 4,871,593 | A | 10/1989 | McIntyre |
| 4,915,767 | A | 4/1990 | Rajala |

(Continued)

FOREIGN PATENT DOCUMENTS

| | | |
|---|---|---|
| CN | 1674999 CN | 9/2005 |
| CN | 102596426 A | 7/2012 |

(Continued)

*Primary Examiner* — Yewebdar T Tadesse
(74) *Attorney, Agent, or Firm* — Craig M. Bohlken

(57) ABSTRACT

An applicator for applying adhesive to a moving web has a housing with an interior chamber, an inlet and a discharge port. The inlet and discharge port are in fluid communication with the interior chamber. A rotor is disposed within the interior chamber of the housing. The rotor has a body and a nonlinear channel extending about at least a portion of the body. The nonlinear channel is selectively positionable for fluid communication with the inlet and the discharge port of the housing such that adhesive flowing into the housing through the inlet flows through and is directed by the nonlinear channel to the discharge port in the housing. The rotor is rotatable relative to the housing to change the position of the nonlinear channel relative to the discharge port and thereby change the location from which adhesive flows from the discharge port.

11 Claims, 10 Drawing Sheets

(56) References Cited

U.S. PATENT DOCUMENTS

| | | | | |
|---|---|---|---|---|
| 4,917,746 | A | 4/1990 | Kons | |
| 5,221,390 | A | 6/1993 | Persson | |
| 5,236,539 | A | 8/1993 | Rogberg | |
| 5,275,676 | A | 1/1994 | Rooyakkers | |
| 5,525,175 | A | 6/1996 | Blenke | |
| 5,660,657 | A | 8/1997 | Rajala | |
| 5,745,922 | A | 5/1998 | Rajala | |
| 5,756,163 | A | 5/1998 | Watanabe | |
| 5,779,689 | A | 7/1998 | Pfeifer | |
| 6,217,690 | B1 | 4/2001 | Rajala | |
| 6,287,409 | B1 | 9/2001 | Stephany | |
| 6,464,785 | B1 | 10/2002 | Puffe | |
| 6,589,149 | B1 | 7/2003 | VanEperen | |
| 8,535,474 | B2 | 9/2013 | Morita | |
| 2001/0032697 | A1* | 10/2001 | Maiwald | A24C 5/24 156/213 |
| 2002/0023706 | A1 | 2/2002 | Vogt | |
| 2004/0087425 | A1 | 5/2004 | Ng | |
| 2005/0241574 | A1 | 11/2005 | Schneider | |
| 2008/0105384 | A1 | 5/2008 | Eckstein | |
| 2008/0289572 | A1 | 11/2008 | Tremblay | |
| 2009/0020211 | A1 | 1/2009 | Andrews | |
| 2009/0157036 | A1 | 6/2009 | Ponomarenko | |

FOREIGN PATENT DOCUMENTS

| | | | |
|---|---|---|---|
| EP | 1842516 | B1 | 11/2009 |
| EP | 2354525 | A1 | 8/2011 |
| JP | 7255777 | A2 | 10/1995 |
| WO | 9623477 | A2 | 8/1996 |
| WO | 04078083 | A1 | 9/2004 |

* cited by examiner

ADHESIVE APPLICATOR WITH ROTARY VALVE

BACKGROUND

The field of the invention relates generally to an applicator for applying adhesive to a web and more particularly to an applicator for applying adhesive in a nonlinear pattern to a moving web.

Absorbent articles, such as disposable diapers, training pants, adult incontinence articles and the like, generally include several different components that are bonded together. One suitable method of bonding these different components together includes the use of adhesive. That is, adhesive can be used to bond individual layers of the absorbent article together. Typical absorbent articles include a bodyside liner, an outer cover, and an absorbent core disposed between the liner and outer cover. Adhesive can be used, for example, to bond each of these layers together. Besides the liner, outer cover, and absorbent core, typical absorbent articles also include a number of discrete components, e.g., fasteners, waist elastics, leg elastics, and the like. Adhesive can also be used to bond these discrete components to the article.

Typically, adhesive is either sprayed or slot-coated on a continuous moving web of either bodyside liner material, outer cover material, or other component material. Difficulties arise, however, when the adhesive and/or the discrete component are applied to the web in a nonlinear pattern such as a curved pattern.

For example, it is known to adhesively bond leg elastics in a curved pattern to a continuous web of outer cover material. The adhesive pattern has a pattern width, which is the distance between the transverse extents of the leg elastics as it is applied to the web. In one conventional approach, adhesive is applied to the outer cover material over the entire adhesive pattern width. Since the leg elastics have a width substantially less than the adhesive pattern width, a significant amount of adhesive is wasted.

As a result, it is desirable to provide an apparatus and method for accurately controlling the pattern in which adhesive is applied in a nonlinear manner to a continuously moving web. An apparatus and method for adhesively bonding a narrow ribbon (e.g., leg elastics) to a moving continuous web in a nonlinear pattern wherein minimal amounts of adhesive are wasted is also desirable.

BRIEF DESCRIPTION

In one aspect, the present invention provides an applicator for applying adhesive to a moving web. The applicator includes a housing and a rotor. The housing has an interior chamber, an inlet, and a discharge port. The inlet and discharge port are in fluid communication with the interior chamber. The rotor is disposed within the interior chamber of the housing. The rotor has a body and a nonlinear channel extending about at least a portion of the body. The nonlinear channel is selectively positionable for fluid communication with the inlet and the discharge port of the housing such that adhesive flowing into the housing through the inlet flows through and is directed by the nonlinear channel to the discharge port in the housing. The rotor is rotatable relative to the housing to change the position of the nonlinear channel relative to the discharge port and thereby change the location from which adhesive flows from the discharge port.

In various embodiments of this aspect, the nonlinear channel is a helical channel extending about a circumference of the rotor. In some embodiments, the discharge port is defined by a slot in the housing. In some embodiments, the slot includes a plurality of cross members defining discrete openings in the slot. In some embodiments, the rotor includes a longitudinally extending passage and a transverse passage that are in fluid communication with the inlet and the slot. In some embodiments, the applicator includes a bypass for directing the adhesive back to a source of the adhesive.

In another aspect, the present invention provides an applicator for applying adhesive to a moving web. The applicator includes a housing and a rotor. The housing has an interior chamber, an inlet in fluid communication with the interior chamber, and a discharge port in fluid communication with the interior chamber. The discharge port has a plurality of cross members defining discrete openings. The rotor is disposed within the interior chamber of the housing. The rotor has a body and a nonlinear channel extending about at least a portion of the body. The body of the rotor includes a longitudinally extending passage and at least one transverse passage fluidly connecting the longitudinally extending passage to the nonlinear channel. The nonlinear channel is selectively positionable for fluid communication with the inlet and the discharge port of the housing such that adhesive flowing into the housing through the longitudinally extending passage and through the transverse passage flows through and is directed by the nonlinear channel to the discharge port in the housing. The nonlinear channel intersects the discharge port to bring the nonlinear channel into fluid communication with the discharge port and to define an intersection which allows the adhesive to exit the discharge port at the intersection. The rotor is rotatable relative to the housing to change the position of the intersection in an axial direction.

In various embodiments, the body of the rotor is generally cylindrical and the nonlinear channel is a helical channel extending about at least a portion of a circumference of the cylindrical body. In some embodiments, the housing includes a selectively detachable end wall for allowing the rotor to be removed from and inserted into the interior chamber of the housing.

In certain embodiments, the discrete openings have a width of 0.03 to 0.06 inches, a spacing of 0.01 to 0.03 inches, and an angle of 75 to 105 degrees as measured relative to the longitudinal axis.

In some embodiments, the body of the rotor includes at least one return passage in fluid communication with the longitudinally extending passage. In some embodiments, the rotor is capable of rotating in both a clockwise direction and a counterclockwise direction and is capable of rotating at a constant speed or a variable speed.

In another aspect, the present invention provides a method of applying adhesive to a moving web. The method includes the steps of directing the adhesive through at least a portion of a housing to a rotor disposed within the housing; directing the adhesive to a longitudinally extending passage within the rotor; directing the adhesive from the longitudinally extending passage to a transverse passage within the rotor; directing the adhesive from the transverse passage to a nonlinear channel formed on the rotor wherein the transverse passage fluidly connects the longitudinal passage to the nonlinear channel; directing the adhesive from the nonlinear channel to a discharge port; discharging the adhesive from the housing through the discharge port and onto the moving web at an intersection of the nonlinear channel and the discharge port; and rotating the rotor within the housing to change the location of the intersection and to change the location from which the adhesive is discharged from the housing through the discharge port.

In some embodiments, the method further includes the steps of rotating the rotor between an ON position and an OFF position. In the ON position the nonlinear channel intersects the discharge port and adhesive is discharged from the discharge port of the housing. In the OFF position the nonlinear channel does not intersect the discharge port and adhesive is prevented from being discharged from the discharge port. In some embodiments, the method further includes the step of directing the adhesive through the rotor and back to the adhesive source in the OFF position.

In some embodiments, the method further includes the step of rotating the rotor within the housing in a first direction and then rotating the rotor within the housing in a second direction opposite the first direction to change the location of the intersection and to change the location from which the adhesive is discharged from the housing through the discharge port.

In various embodiments, the method further includes the steps of continuously directing adhesive through at least a portion of the housing; intermittently discharging the adhesive from the housing through the discharge port and onto the moving web; and intermittently blocking the adhesive from the discharge port and discharging the adhesive from the housing via a return passage.

In various embodiments, the method further includes the steps of rotating the rotor to a first position and discharging the adhesive from a first portion of the slot; rotating the rotor to a second position and discharging the adhesive from a second portion of the slot different than the first portion; and rotating the rotor to a third position and discharging from a third portion of the slot different than the first portion and the second portion. In various embodiments, rotating the rotor to the first position, the second position, and the third position collectively is less than one full rotation of the rotor.

In various embodiments, the method includes a rotor with two or more nonlinear channels. In these embodiments, the method further includes the steps of discharging adhesive from a first nonlinear channel through a first location of the slot; rotating the rotor; and discharging adhesive from a second nonlinear channel through the first location of the slot, wherein the second nonlinear channel is separate and distinct from the first nonlinear channel.

BRIEF DESCRIPTION OF THE DRAWINGS

Corresponding reference characters indicate corresponding parts throughout the drawings.

DETAILED DESCRIPTION OF THE DRAWINGS

Figure 1:
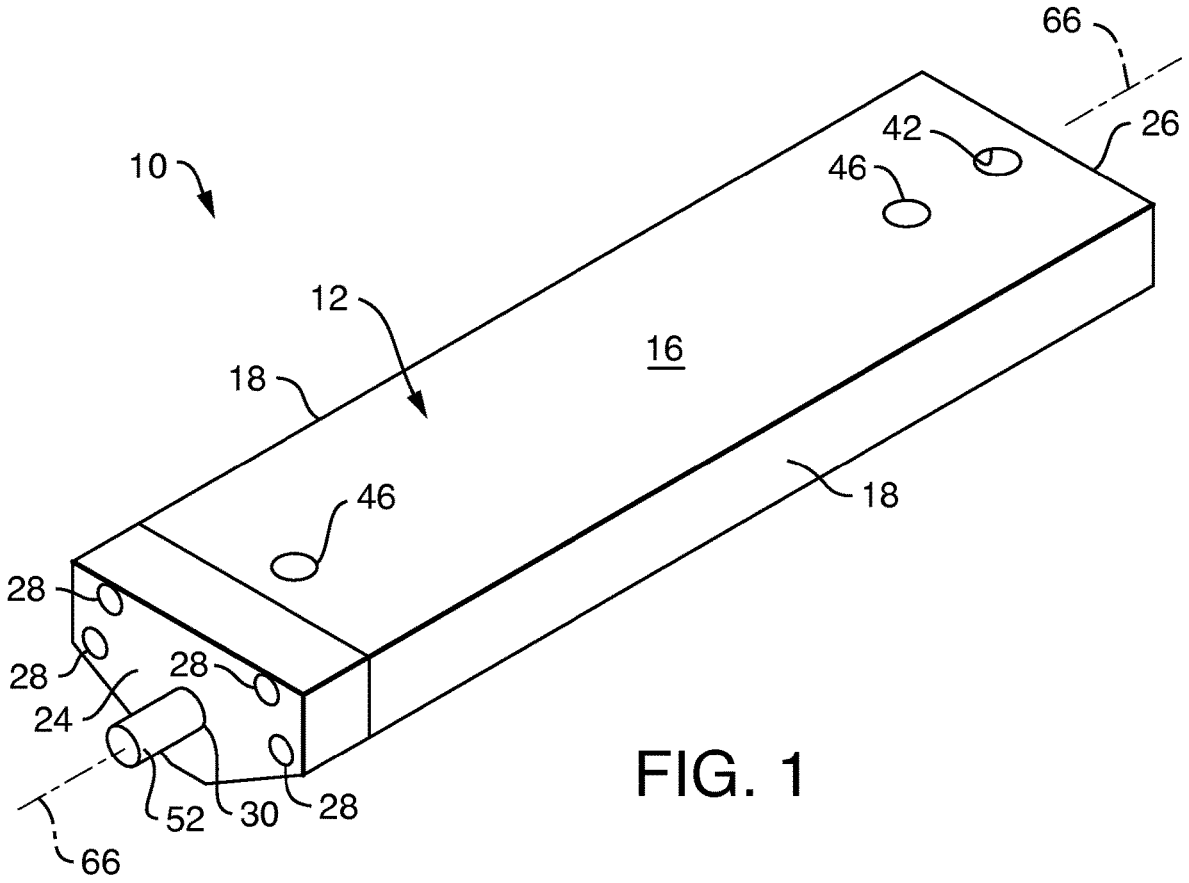
FIG. 1 is a topside perspective of one suitable embodiment of an applicator of the present invention.
Figure 2:
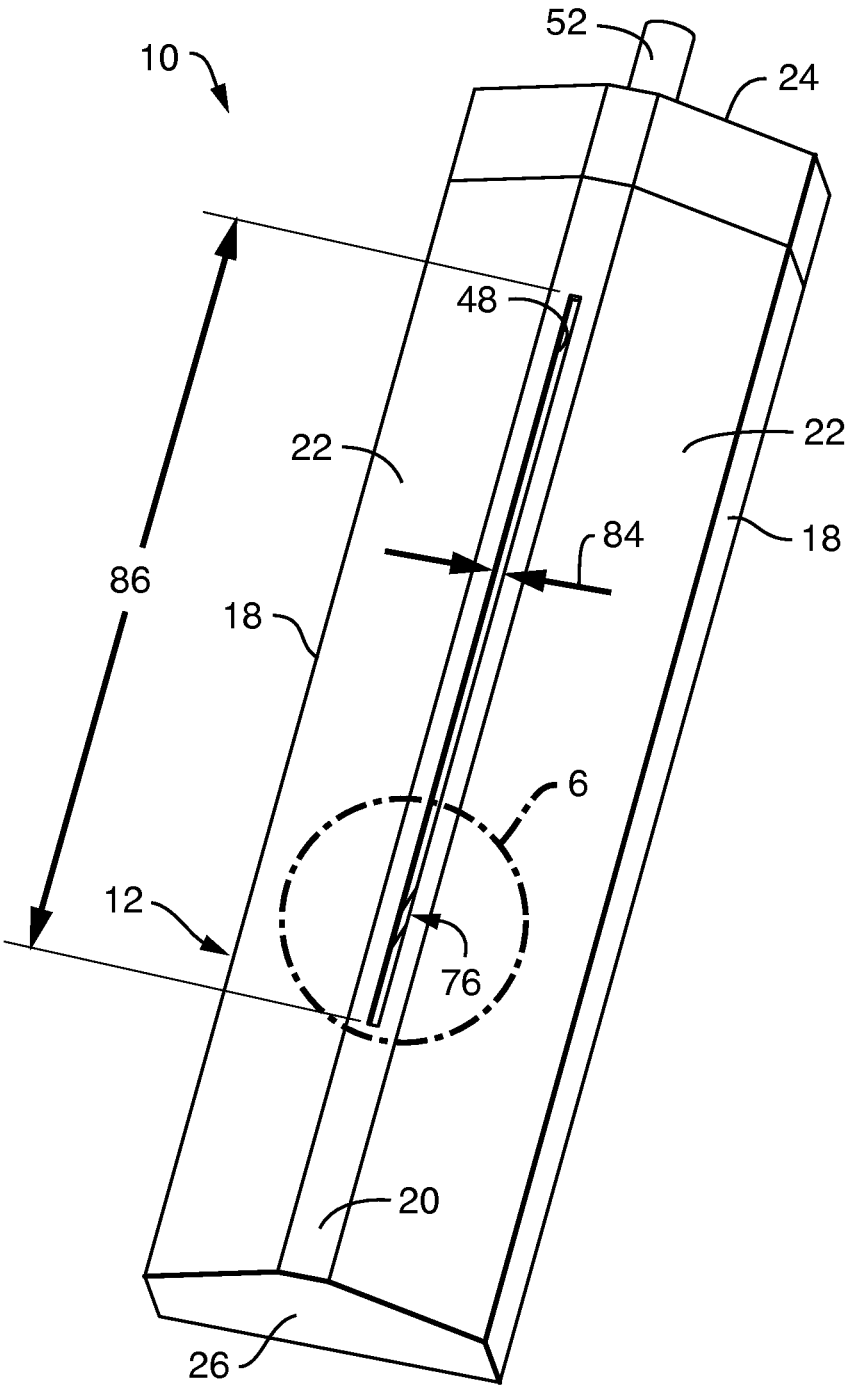
FIG. 2 is a bottom side perspective of the applicator of FIG. 1 with optional elements omitted for clarity.
Figure 3:
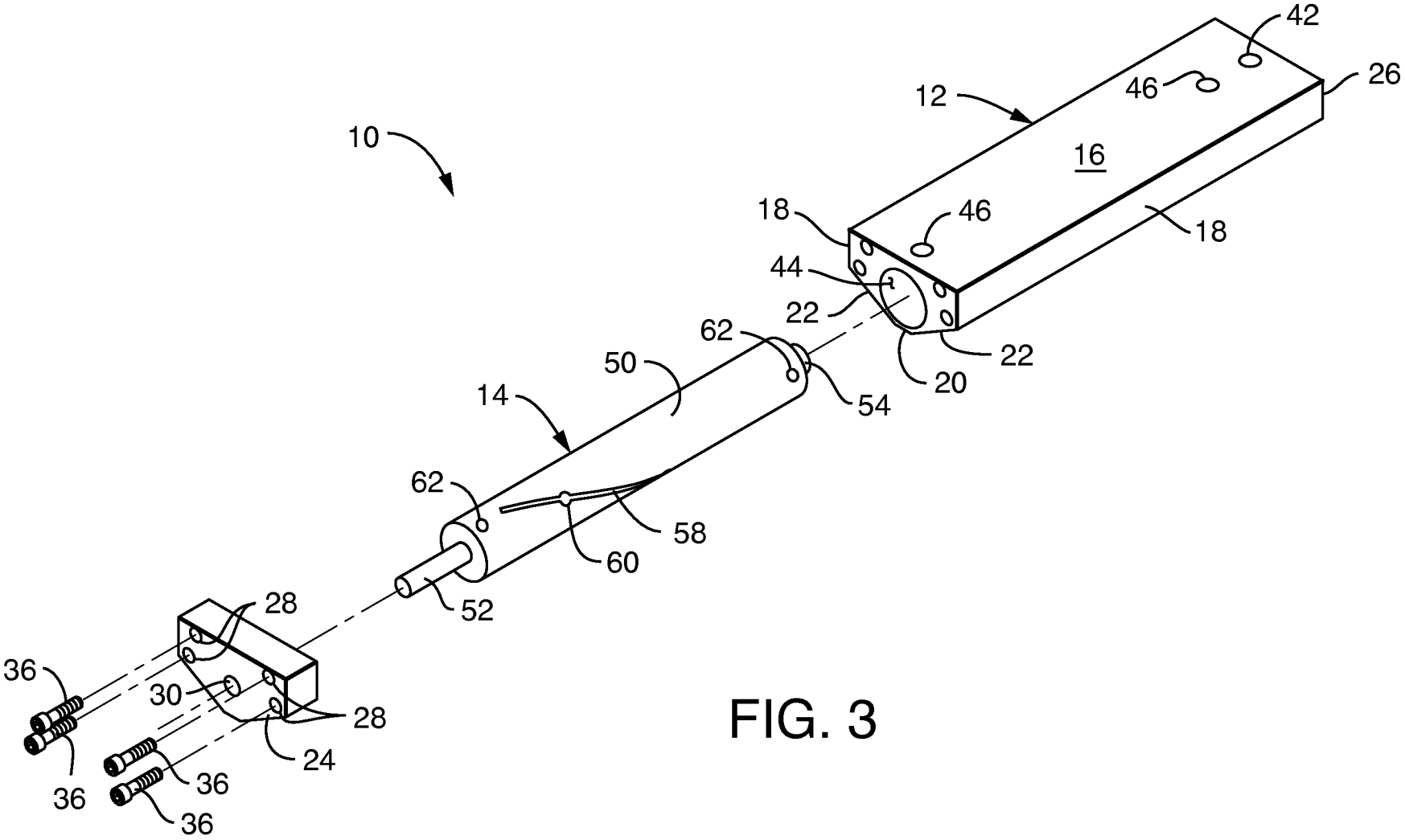
FIG. 3 is an exploded perspective of the applicator of FIG. 1.

FIGS. 1-3 illustrate one embodiment of an adhesive applicator, which is indicated generally at 10. FIG. 1 is a topside perspective view of an exemplary embodiment of an applicator of the present invention. FIG. 2 is a bottom side perspective view of the applicator of FIG. 1. FIG. 3 is an exploded perspective view of the applicator of FIG. 1. The applicator comprises a housing, indicated generally at 12, and a rotor, indicated generally at 14 (FIG. 3). The rotor 14 is rotatably mounted within the housing 12. In the illustrated embodiment, the housing 12 has a generally planar top wall 16 and two side walls 18 extending downward from the top wall (FIG. 1). As seen in FIG. 2, the housing 12 also has a generally planar bottom wall 20 and two sloping walls 22 extending between respective ones of the side walls 18 and the bottom wall 20. In the illustrated embodiment, the bottom wall 20 has a length that is approximately six times less than the length of the top wall 16. It is contemplated, however, that the top and bottom walls 16 and 20 can have different relative lengths including being substantially equal.

The housing 12 further includes first and second end walls 24, 26. The first end wall 24 includes a plurality of generally circular bolt openings 28 and a generally circular shaft opening 30. In the illustrated embodiment, the shaft opening 30 has a larger diameter than the bolt openings 28 but it is understood that the diameters of the bolt openings and shaft opening can be different than those illustrated herein. Referring now to FIGS. 7-11, which illustrate vertical cross sections of the applicator 10 of FIG. 1 in various positions, an interior face of the first end wall 24 includes a circular recess 32 that is axially aligned with the shaft opening 30. A shoulder 34 extends annularly about the recess 32. The recess 32 and shoulder 34 of the first end wall 24 will be described in more detail below.

In the illustrated embodiment, the first end wall 24 is selectively attachable and detachable from the remainder of the housing 12 (FIGS. 1-3). More specifically, the first end wall 24 is selectively securable to the housing 12 using a plurality of bolts 36 (e.g., four bolts). Two of the bolts 36 secure the first end wall 24 to the top wall 16 and the other two bolts secure the first end wall to respective side walls 18 of the housing 12. Thus, each of the bolts 36 is received through one of the bolt openings 28 in the first end wall 24 and secured to either the top wall 16 or one of the side walls 18. It is contemplated, however, that the first end wall 24 can be releasably secured to the remainder of the housing 12 in other ways (e.g., snap fit). It is also contemplated, that the first end wall 24 can be non-releasably secured to the remainder of the housing 12 or may be integrally formed with the remainder of the housing 12.

With reference again to FIGS. 7-11, the second end wall 26 includes an interior recess 38, an annular shoulder 40 extending about the recess 38, and an inlet 42. In the illustrated embodiment, the inlet 42 is generally L-shaped and includes a transverse component 42*a* and a longitudinal component 42*b*. The longitudinal component 42*b* of the inlet 42 is generally axially aligned with the interior recess 38.

The top wall 16, the bottom wall 20, the side walls 18, the sloping walls 22, the first end wall 24, and the second end wall 26 cooperatively define an interior chamber 44 of the housing 12. In the illustrated embodiment, the interior chamber 44 of the housing 12 is generally cylindrical to receive the generally cylindrical shaped rotor 14 (FIG. 3). It is contemplated, however, that the interior chamber 44 of the housing 12 can have different shapes (e.g., conical, frustum) to receive a rotor having a shape other than cylindrical (e.g., conical, frustum).

In the illustrated embodiment, the top wall 16, the bottom wall 20, the side walls 18, the sloping walls 22, and the second end wall 26 of the housing 12 are formed as one piece (e.g., by a molding process). It is contemplated, however, that one or more of these can be formed separately and can be attached to the other components of the housing 12. For example, it is contemplated that the second end wall 26 can be releasably secured to the remainder of the housing 12 instead of, or in addition to, the first end wall 24.

In the illustrated embodiment, the housing 12 has an octahedron shape but it is understood that the housing can have other shapes (e.g., block, hexagon, cylindrical) without departing from the scope of this invention. It is also understood that the housing 12 can be made from any suitable material or combination of materials (e.g., suitable polymers and metals).

As illustrated in FIGS. 7-11, the inlet 42 in the second end wall 26 of the housing 12 is in fluid communication with the interior chamber 44 of the housing 12. A pair of outlets 46 is also in fluid communication with the interior chamber 44. In one suitable embodiment, the two outlets 46 extend through the top wall 16 and are generally aligned with a longitudinal axis 66 of the applicator 10 (FIG. 1) and the inlet 42. It is understood, however, that the inlet 42 and the outlets 46 can have other arrangements and configurations without departing from the scope of this invention. For example, the inlet 42 and/or the outlets 46 can be located on one of the sidewalls 18.

Figure 6:
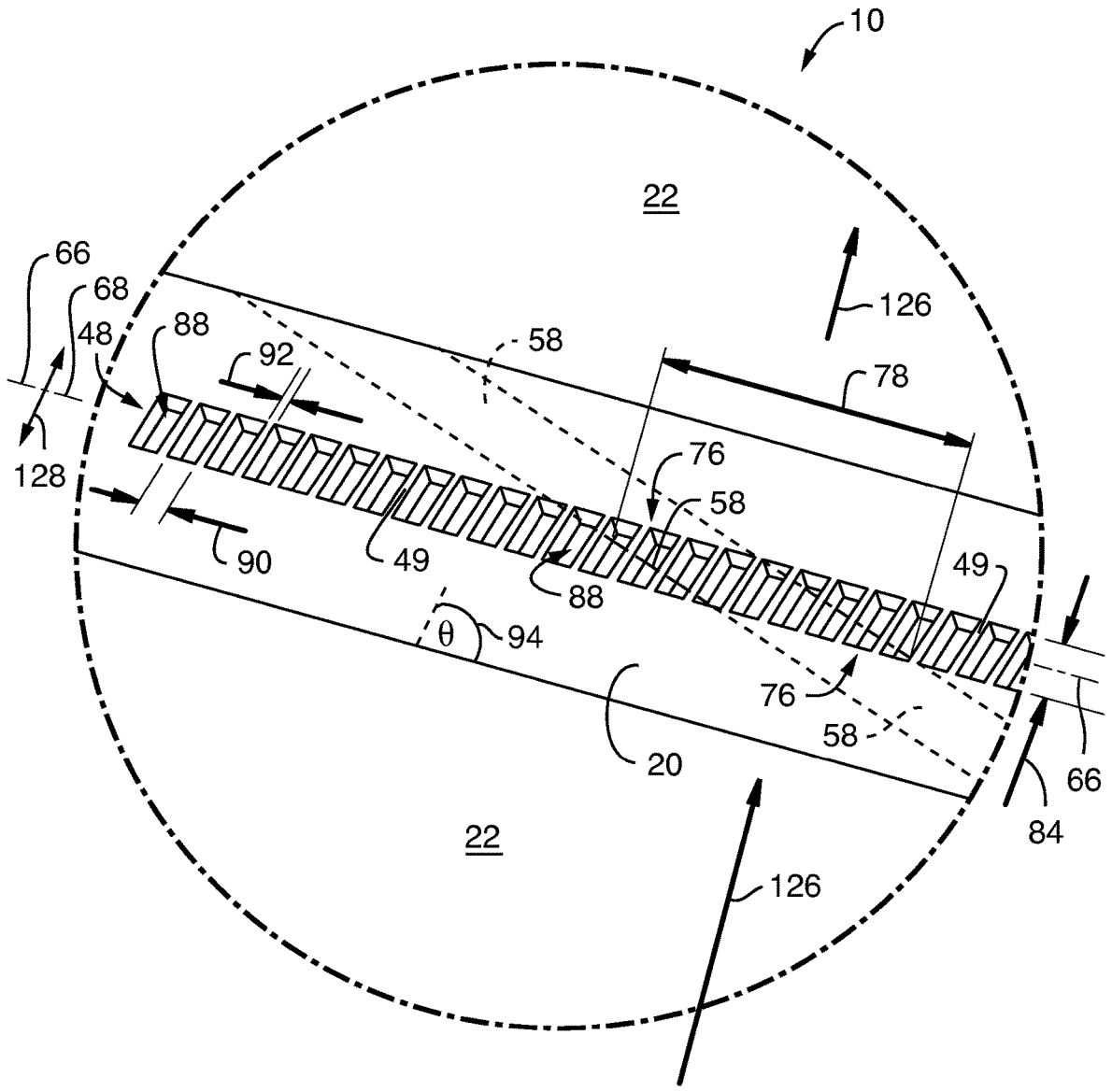
FIG. 6 is an enlarged view of a portion of the applicator illustrated in FIG. 2 with optional elements added.

As seen in FIG. 2, the bottom wall 20 of the housing 12 includes an elongate slot 48 (broadly, "a discharge port") in fluid communication with the interior chamber 44 (FIGS. 7-11). In the illustrated embodiment, the slot 48 is generally rectangular having any suitable length 84 and any suitable width 86 (FIG. 2). In various embodiments, the slot 48 may have a length 84 of 0.1 to 0.2 inches. In certain embodiments, the slot 48 may have a length 84 of approximately 0.125 inches. In various embodiments, the slot 48 may include optional cross members 49 forming a "comb-like" configuration. The optional cross members 49 are not illustrated in FIG. 2 for clarity but are illustrated in FIG. 6, which is an enlarged view of a portion of FIG. 2. It is contemplated, however, that the slot 48 can be continuous and/or have different shapes and/or different cross members without departing from the scope of this invention.

Referring now to FIG. 6, the cross members 49 effectively divide the slot 48 into multiple openings 88 having any suitable width 90, any suitable spacing 92, and any suitable angle 94. For example, in some embodiments, the openings 88 may have a width 90 of 0.01 to 0.1 inches, 0.03 to 0.06 inches, or about 0.04 inches. In some embodiments, the openings 88 may have a spacing 92 of 0.005 to 0.5 inches, 0.01 to 0.03 inches, or about 0.02 inches. In some embodiments, the openings 88 may have an angle 94 of 15 to 175 degrees, 30 to 160 degrees, or 75 to 105 degrees. In some embodiments, the spacing 92 may be consistent from opening to opening. In other embodiments, the spacing 92 may be variable between openings to provide gaps in the adhesive pattern formed.

Figure 4:
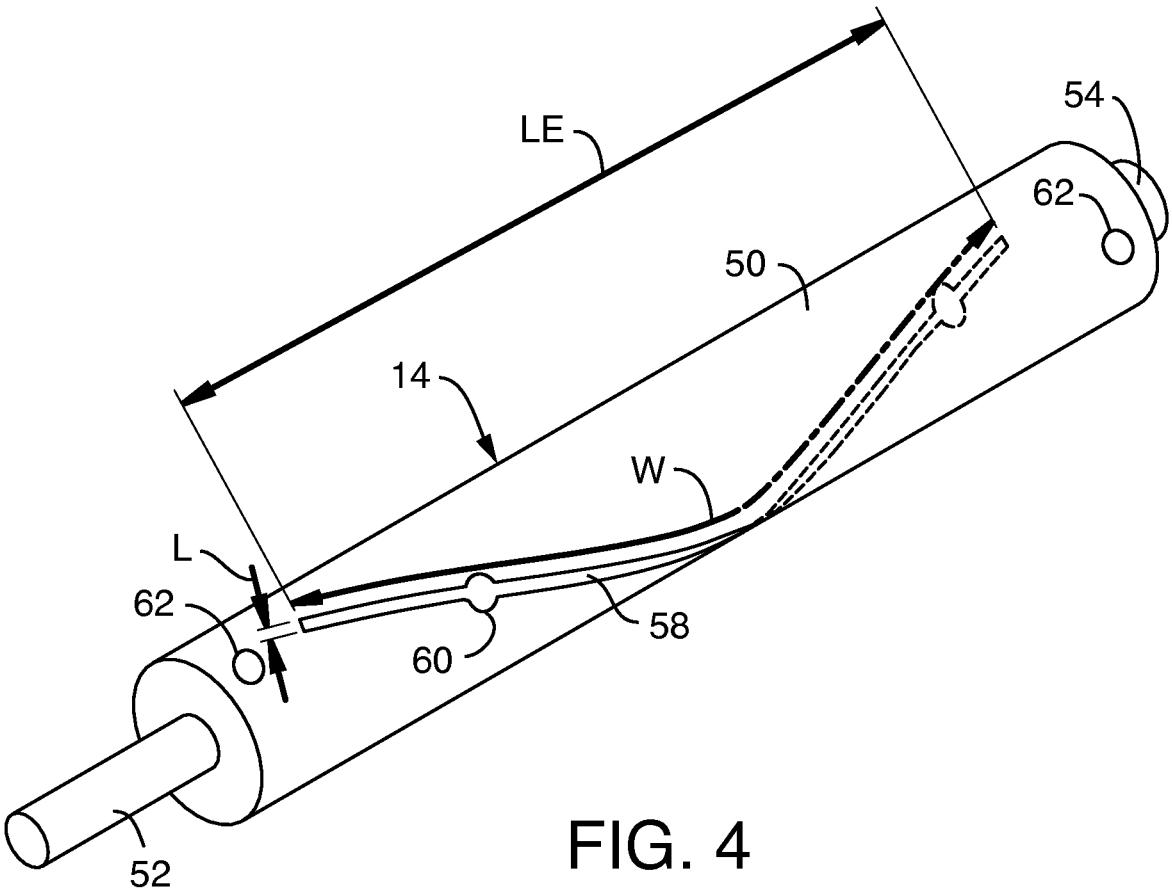
FIG. 4 is a perspective view of a rotor removed from the applicator of FIG. 1.
Figure 5:
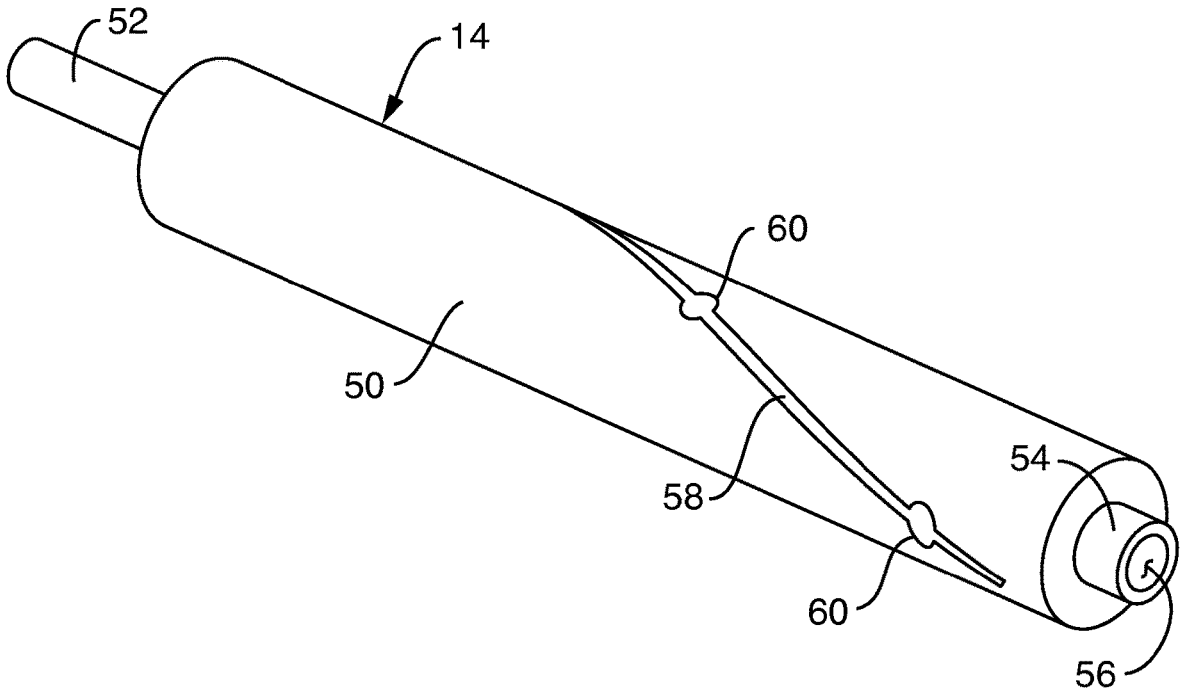
FIG. 5 is a perspective view similar to FIG. 4 but with the rotor rotated.

As seen in FIGS. 4 and 5, the rotor 14 includes a cylindrical body 50, a shaft 52 extending outward from one end of the body, and an annular rib 54 extending outward from the body on the end opposite the shaft. The rotor 14 is sized and shaped to fit within the interior chamber 44 of the housing 12 (FIG. 3). It is contemplated that the body 50 of the rotor 14 can have shapes other than cylindrical (e.g., conical, frustum). Suitably, the gap between the rotor 14 and the housing 12 is between approximately 0.0005 inches and approximately 0.005 inches. This relatively tight gap is believed to allow free rotation of the rotor within the interior chamber 44 of the housing 12 while preventing adhesive from migrating between the rotor 14 and the chamber 44. In some embodiments, the housing 12 and the rotor 14 may be made of the same metal to have similar expansion and contraction when heating and cooling to help maintain a relatively consistent clearance between the housing 12 and the rotor 14. Suitable metals include aluminum, carbon steel, stainless steel, and the like.

Figure 7:
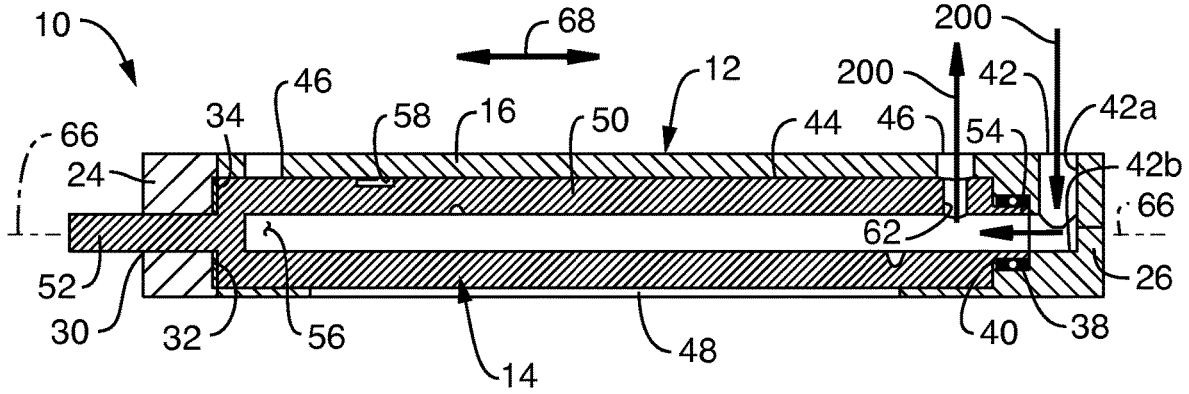
FIG. 7 is a vertical cross-section of the applicator of FIG. 1 illustrating the applicator in a first OFF position.
Figure 8:
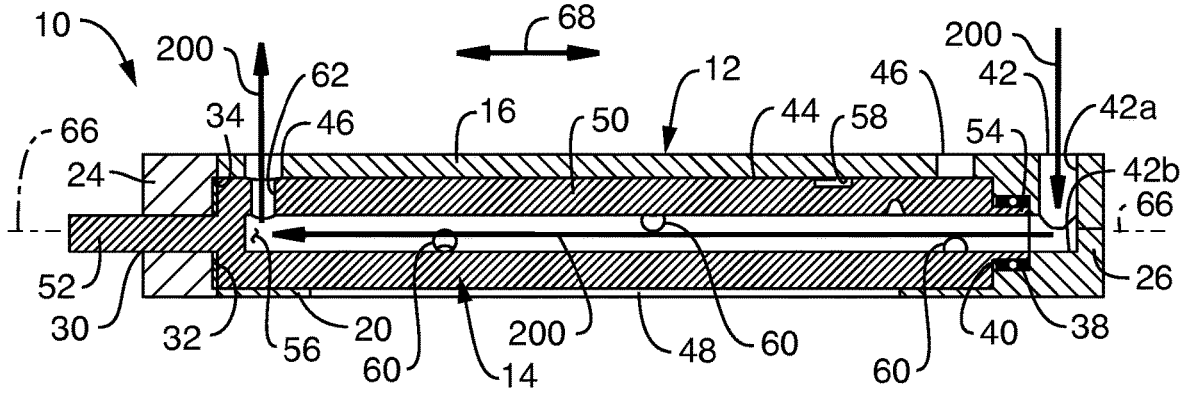
FIG. 8 is a vertical cross-section of the applicator of FIG. 1 illustrating the applicator in a second OFF position.

As seen in FIGS. 5 and 7-11, the rotor 14 includes a longitudinally extending passage 56 that is axially aligned with the body 50, the shaft 52, and the annular rib 54. The longitudinal passage 56 is fluidly connected to a helical channel 58 (broadly, "a nonlinear channel") by a plurality of transverse passages 60. The illustrated embodiment of the rotor 14 includes three transverse passages 60 but it is contemplated that the rotor could have more or fewer transverse passages. With reference to FIG. 4, a pair of optional off-set, spaced-apart return passages 62 is also fluidly connected to the longitudinal passage 56 (FIGS. 5, 7 and 8). Each of the return passages 62 is arranged to selectively align with and provide fluid communication with one of the outlets 46 in the top wall 16 of the housing 12.

As seen in FIGS. 4 and 5, the helical channel 58 spirals about a portion of a circumference of the rotor 14. The illustrated helical channel 58 is continuous and has a width W, length L, and a longitudinal extent LE. The longitudinal extent LE of the helical channel 58 may be approximately equal to a width of the longitudinal slot 48 in the bottom wall 20 of the housing 12. It is contemplated, however, that the helical channel 58 can have a longitudinal extent LE that is less than or greater than the width of the slot 48 in the bottom wall 20 of the housing 12. It is also contemplated that the helical channel 58 can be discontinuous. In the illustrated embodiment, for example, the helical channel could comprise three discrete segments with each segment being fluidly connected to the longitudinal passage 56 by one of the three transverse passages 60.

With reference still to FIGS. 4 and 5, the helical channel 58 in the illustrated embodiment has a pitch (or angle) such that it extends around about 270 degrees of the circumference of the rotor body 50. It is contemplated that the helical channel 58 can have a greater pitch (i.e., extend around a greater portion of the circumference of the rotor body 50) or a lesser pitch (i.e., extend around a lesser portion of the circumference of the rotor body 50). In one embodiment with the helical channel having a greater pitch, the helical channel 58 can extend about the body 50 of the rotor 14 more than 360 degrees. It is also contemplated that the length L and width W of the helical channel 58 can be greater than or less than those of the illustrated embodiment.

The illustrated rotor 14 has a single helical channel 58. It is contemplated, however, the rotor 14 can have more than one helical channel 58. That is, the rotor 14 can have two or more helical channels 58 and the channels can be isolated from each other or interconnected at one or more locations.

With reference again to FIGS. 1-3, the rotor 14 can be selectively inserted into and removed from the interior chamber 44 of the housing 12 by removing the first end wall 24 of the housing and thereby exposing the interior chamber. With the rotor 14 received within the interior chamber 44 of the housing 12 and the first wall 24 attached to the housing, the shaft 52 of the rotor 12 extends through the shaft opening 30 in the first end wall. The annular rib 54 of the rotor 14 is received within the recess 38 in the second end wall 26 of the housing 12 and supported by the shoulder 40 extending about the recess (FIGS. 7-11). The longitudinal passage 56 in the rotor body 50 is axially aligned with the longitudinal component 42*b* of the inlet 42 in the second end wall 26 of the housing 12. Once inserted, the inlet 26, the longitudinally passage 56, the transverse passages 60, the non-linear channel 58, and the discharge port 48 can be selectively aligned to all be in fluid communication. The nonlinear channel 58 can be selectively aligned to intersect the discharge port 48 thereby bringing the nonlinear channel 58 into fluid communication with the discharge port 48 and to define an intersection 76 (FIGS. 2 and 6).

The intersection 76 defines a width 78 as measured parallel to the longitudinal axis 66 as illustrated in FIG. 6. The intersection 76 can be aligned in close proximity to a web (not illustrated) moving along a web path 126 in a machine direction 128. The machine direction 128 is generally perpendicular to the longitudinal axis 66 of the applicator 10 but may be non-perpendicular in some embodiments (not illustrated). The web path 126 is generally parallel with the machine direction 128.

The rotor 14 can be rotationally driven by a suitable drive system 70, e.g., servo motors, gears, pulleys, belts, couplings, and like. The drive system 70 applies a torque to the shaft 52 of the rotor, which extends outward from the housing 12. The rotational drive system 70 is illustrated in FIG. 12. The applicator 10 can be moved between a first OFF position (FIG. 7), a second OFF position (FIG. 8), and various ON positions (FIGS. 9-11) by the drive system 70 rotating the rotor 14.

In one suitable embodiment, the drive system 70 is capable of rotating the rotor 14 in both clockwise and counterclockwise directions and at variable rotational speeds. In one configuration, the drive system 70 is capable of rotating the rotor 14 at a rotational speed up to approximately 3000 revolutions per minute. It is contemplated that in other embodiments, the drive system 70 can be a single direction drive system for driving the rotor 14 in either the clockwise direction or the counterclockwise direction. It is also contemplated that the drive system 70 can have a single rotational, operating speed (i.e., not variable). It is also contemplated that in other embodiments, the drive system 70 can be an oscillating drive system that alternately drives the rotor 14 in the clockwise direction and in the counterclockwise direction. It is also contemplated that in other embodiments, the drive system 70 can be an oscillating drive system that alternatively drives the rotor 14 in the clockwise direction and in the counterclockwise direction at variable speeds.

In use, adhesive 200 is directed through the inlet 42 in the second end wall 26 of the housing 12 from an adhesive source 80 (FIG. 12) and into the longitudinal passage 56 of the rotor 14 (FIGS. 7-11). The adhesive source 80 is capable of heating the adhesive to a suitable temperature and driving the adhesive at a suitable pressure. In the first OFF position, which is illustrated in FIG. 7, the adhesive 200 (illustrated with bolded arrows) flows through only a small portion of the longitudinal passage 56 and out of the rotor 14 via one of the two optional return passages 62 therein. The return passage 62 is aligned with one of the outlets 46 in the housing 12 (i.e., the outlet adjacent the second sidewall 26) such that the adhesive 200 flows from the applicator 10. The adhesive 200 is then returned to the adhesive source 80 via a conduit (not shown) connected to the outlet 62. In the second OFF position the adhesive 200 flows through the longitudinal passage 56 and out the rotor 14 via the other return passage 62 (FIG. 8). This return passage 62 is aligned with the other outlet 46 in the housing 12 (i.e., the outlet adjacent the first side wall 24) such that the adhesive 200 flows from the applicator 10. The adhesive 200 is then returned to the adhesive source 80 via a conduit (not shown) connected to the outlet 46. Thus, the first and second OFF positions of the applicator 10 provide closed loop bypasses whereby adhesive 200 is directed through the applicator 10 and back to the adhesive source 80. In some embodiments, the return passages 62 may include one or more restrictors to regulate the resistance to adhesive flow. The restrictors may be adjusted such that the recirculation pressure is similar to the exit pressure of the adhesive. Controlling the restriction can help reduce the pressure that may result in an adhesive surge when the rotary adhesive valve is moved to an ON position (i.e., opened). Likewise, controlling the restriction can help maintain pressure in the system to prevent a delay in adhesive exiting the applicator when the valve is opened. Too little restriction may also result in at least partial adhesive recirculation during ON times instead of exiting the discharge port 48.

In an alternative embodiment without return passages (not illustrated), the OFF positions prevent adhesive flow to the longitudinal passage 56. The adhesive is then dead-headed at the inlet 42. In these embodiments, the OFF positions of the applicator 10 do not provide closed loop bypasses whereby adhesive is directed back to the adhesive source 80. In these embodiments, a regulator or controller may be used to control input pressure. For example, the controller can regulate the torque of the adhesive pump motor relative to a fixed pressure set point.

Figure 9:
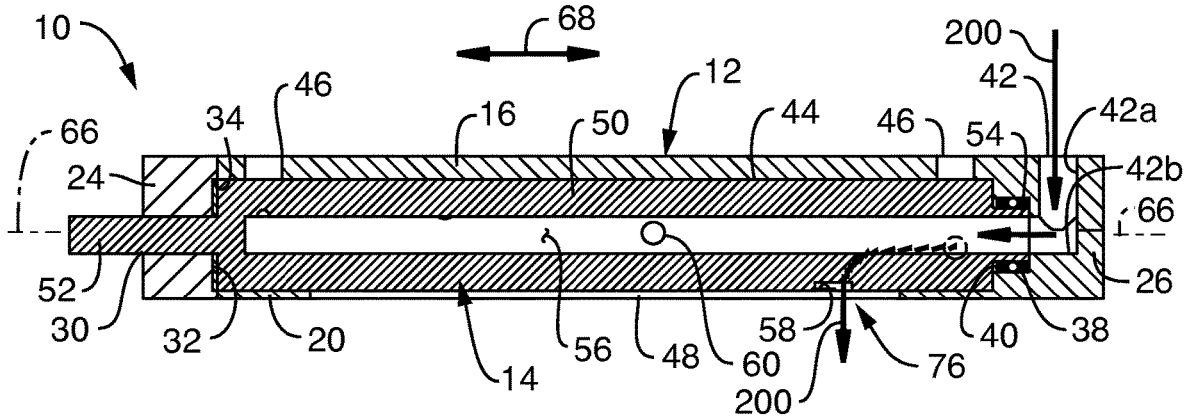
FIG. 9 is a vertical cross-section illustrating the applicator of FIG. 1 in an ON position.
Figure 10:
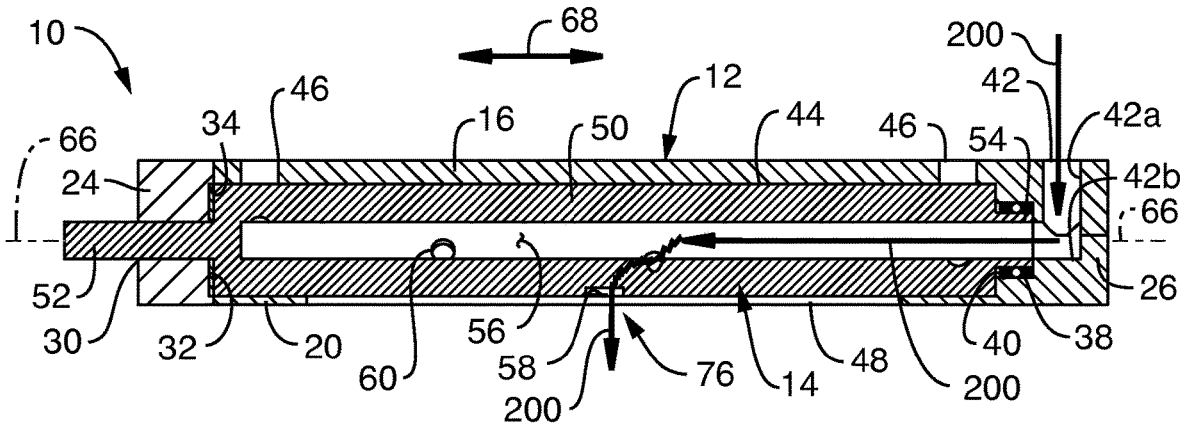
FIG. 10 is a vertical cross-section similar to FIG. 9 but showing the rotor in another ON position and rotated from its position in FIG. 9.
Figure 11:
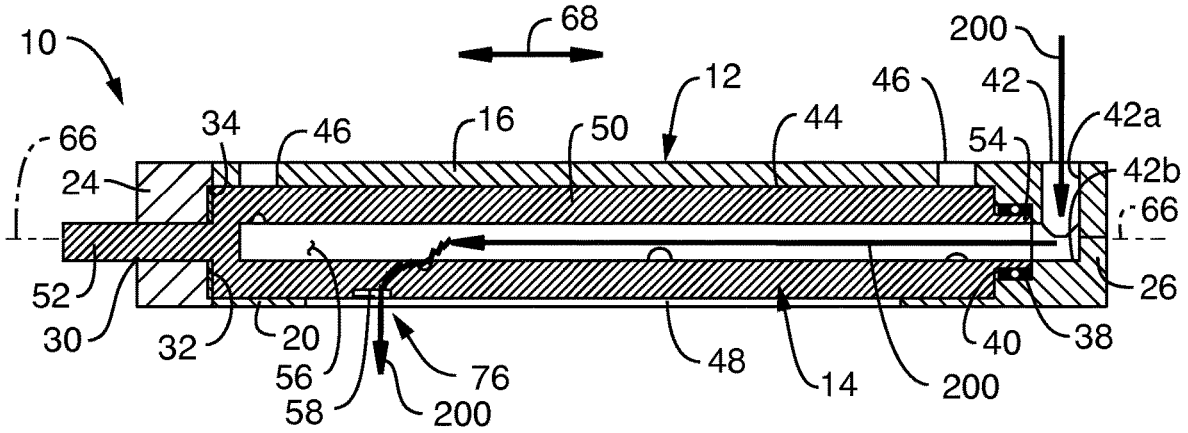
FIG. 11 is a vertical cross-section similar to FIG. 10 but showing the rotor in another ON position and rotated from its positions in FIGS. 9 and 10.
Figure 12:
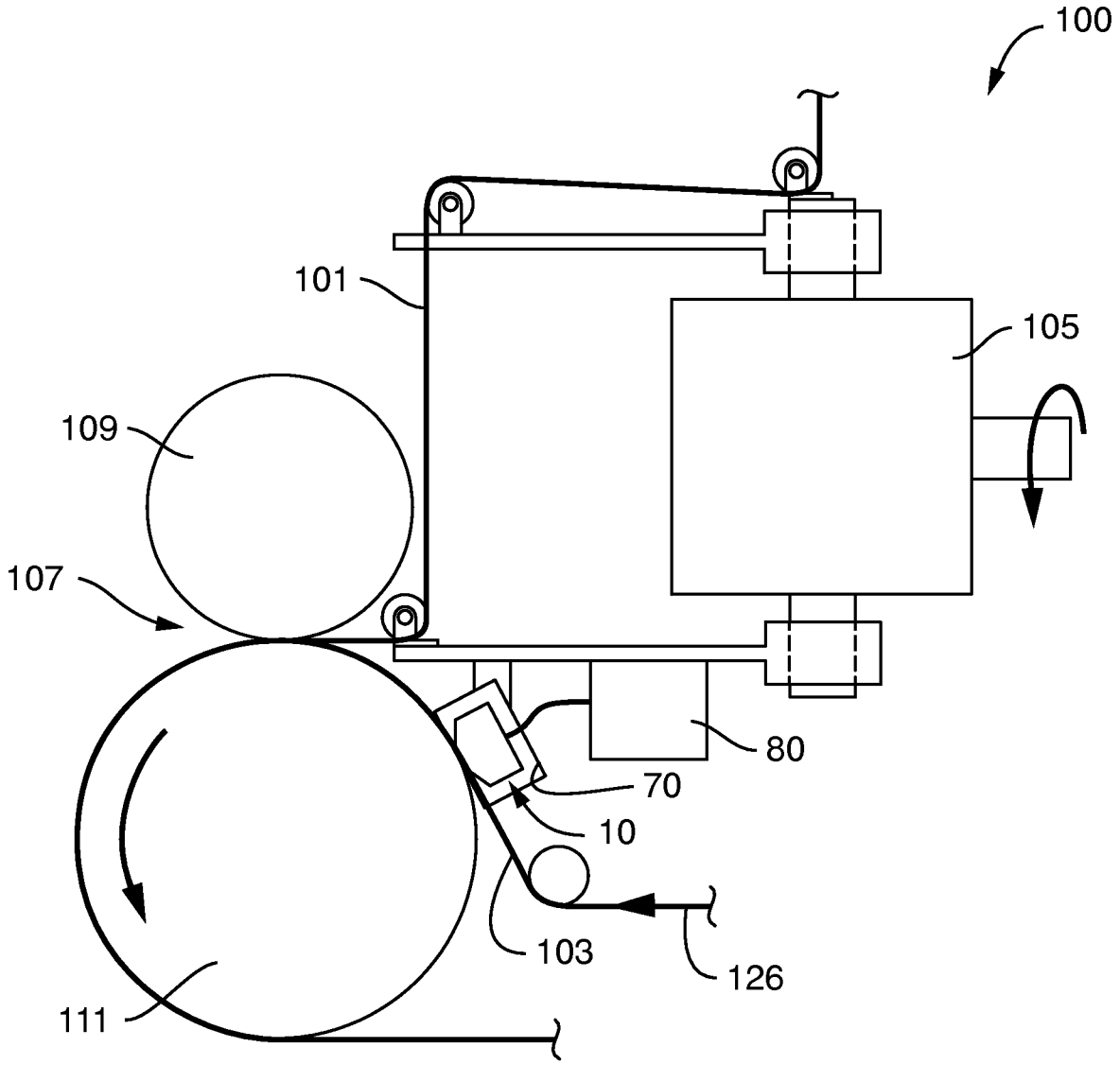
FIG. 12 is a schematic illustrating an apparatus for applying a ribbon to a web, the apparatus including the applicator of FIG. 1.

FIGS. 9-11 illustrate the applicator 10 in various ON positions. In these embodiments, the adhesive 200 is driven through the inlet 42 in the second end wall 26 of the housing 12 by the adhesive source 80 and into the longitudinal passage 56 of the rotor 14. The adhesive 200 flows through the longitudinal passage 56, through transverse passages 60, and into the nonlinear channel 58. The adhesive 200 flows from the helical channel 58 and out the slot 48 in the bottom wall 20 of the housing 12 at the location where the helical channel 58 and the slot 48 align to define an intersection 76. The location that adhesive flows from the slot 48 can be changed by rotation of the rotor 14, which changes the axial location of the intersection 76 between the helical channel 58 and the slot 48 as seen in FIGS. 9-11.

Rotating the rotor 14 in one direction (i.e., either clockwise or counterclockwise) causes the location at which the helical channel 58 intersects the slot 48 to move progressively along the length of the slot. A desired nonlinear pattern of adhesive (e.g., a curved pattern) can be achieved by varying the rotational speed and direction of rotation of the rotor 14 in conjunction with the web 103 moving perpendicularly past the slot as illustrated in FIG. 12 and as described in more detail below.

In embodiments wherein the slot 48 includes cross members 49, the adhesive flows from the helical channel 58 and out the openings 88 defined by the cross members 49 at the location where the helical channel and the openings 88 align, i.e., the intersection 76. Rotating the rotor 14 causes the location at which the helical channel 58 intersects the slot 48 (the intersection 76) to move progressively along the length of the slot 48 and results in adhesive 200 progressively exiting the various openings 88. It is believed that the use of cross members 49 to divide the slot 48 into multiple openings 88 helps to direct the adhesive 200 from the helical channel 58 out the openings 88 while minimizing propagation of the adhesive along the slot 48. In other words, the cross members 49 provide multiple end points at which adhesive can no longer move in an axial direction 68 along the slot 48 and therefore is forced to move out the slot 48 through the slot openings 88 in a direction perpendicular to the axial direction 68.

Figure 13:
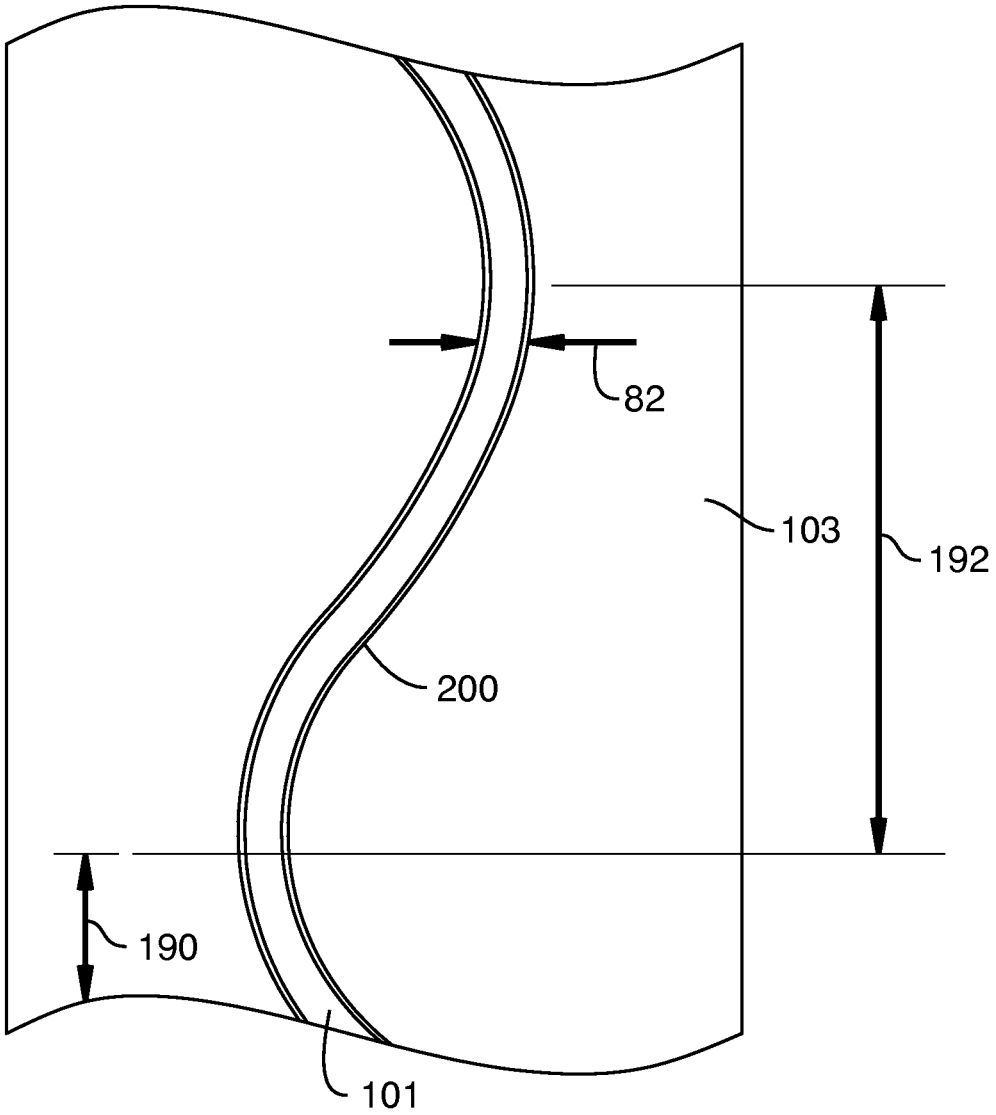
FIG. 13 is a top view of a web showing a ribbon adhered thereto in a nonlinear pattern.

As illustrated in FIG. 12, the applicator 10 can be incorporated into an apparatus, indicated generally at 100, for adhering a ribbon 101 in a nonlinear pattern to a web 103 having a non-linear pattern of adhesive 200 as illustrated in FIG. 13. The apparatus 100 includes a ribbon delivery and application device 105 configured to deliver and apply the ribbon 101 to the web 103 in a nonlinear pattern. As seen in FIG. 12, the web 103 is delivered from a web source (not shown) past the applicator 10 wherein adhesive 200 is applied to the web in a nonlinear pattern using the apparatus and method described above. For example, the rotor 14 may include a helical channel 58 that may be rotated in a first rotational direction to move the intersection 76 between the helical channel 58 and the discharge port 48 in a first axial direction while the web 103 moves along the web path 126 forming a first portion 190 of a curved pattern of adhesive 200 as seen in FIG. 13. The rotor 14 may then be rotated in a second rotational direction, opposite the first rotational direction, to move the intersection 76 in a second axial direction, opposite the first axial direction, while the web 103 continues to move along the web path 126 forming a second portion 192 of the curved pattern of adhesive 200.

In another example, the rotor 14 may include a nonlinear channel 58 that may be rotated in a first rotational direction to move the intersection 76 between the nonlinear channel 58 and the discharge port 48 in a first axial direction while the web 103 moves along the web path 126 forming a first portion 190 of a curved pattern of adhesive 200 as seen in FIG. 13. The rotor 14 may then continue to be rotated in the first rotational direction to move the intersection 76 in a second axial direction, opposite the first axial direction, while the web 103 continues to move along the web path 126 forming a second portion 192 of the curved pattern of adhesive 200. In this example, the nonlinear channel 58 may be formed on the rotor 14 in a pattern that curves first in one direction and then in a second opposite direction such that the intersection 76 between the nonlinear channel 58 and the discharge port 48 moves alternately between the first axial direction and the second axial direction without changing the rotational direction of the rotor 14.

The ribbon 101 is fed from a ribbon source (not shown) to the delivery and application device 105. The delivery and application device 105 applies the ribbon 101 to the web 103 in a nonlinear pattern such that the ribbon overlies the nonlinear pattern of adhesive 200 that is applied to the web 103. The web 103, having the ribbon 101 applied thereto, is delivered to a nip 107 defined by two rollers 109, 111. The nip 107 presses the ribbon 101, the web 103, and the adhesive 200 into contact. In various embodiments, additional webs of material (not shown) may be included to overlay any exposed adhesive to aid in further processing of the composite web.

One suitable embodiment of the resulting composite (i.e., the web 103 having the ribbon 101 adhered thereto via adhesive 200) is illustrated in FIG. 13. The composite can be used in the manufacture of absorbent articles (e.g., diapers, training pants, articles for incontinence). In one particularly suitable configuration, the web 103 defines a liner or outercover of the absorbent article and the ribbon 101 defines leg elastics of the absorbent article.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements. Moreover, the use of "top", "bottom", "above", "below" and variations of these terms is made for convenience, and does not require any particular orientation of the components.

As various changes could be made in the above without departing from the scope of the invention, it is intended that all matter contained in the above description and shown in the accompanying drawings shall be interpreted as illustrative and not in a limiting sense.

What is claimed is:

1. An applicator for applying adhesive to a moving web, the applicator comprising:

a housing having an interior chamber, an inlet, and a discharge port, the inlet and discharge port being in fluid communication with the interior chamber; and a rotor disposed within the interior chamber of the housing, the rotor having a body and a nonlinear channel wherein the nonlinear channel is a helical channel extending about a circumference of the rotor, the nonlinear channel being selectively positionable for fluid communication with the inlet and the discharge port of the housing such that adhesive flowing into the housing through the inlet flows through and is directed by the nonlinear channel to the discharge port in the housing, the rotor being rotatable relative to the housing to change the position of the nonlinear channel relative to the discharge port and thereby change the location from which adhesive flows from the discharge port.

2. The applicator as set forth in claim 1 wherein the discharge port is defined by a slot in the housing.

3. The applicator as set forth in claim 2 wherein the slot includes a plurality of cross members defining discrete openings.

4. The applicator as set forth in claim 3 wherein the rotor comprises a longitudinally extending passage and a transverse passage and wherein the inlet, the longitudinally extending passage, the transverse passage, and the slot are all in fluid communication.

5. The applicator as set forth in claim 1 further comprising a bypass for directing adhesive back to a source of adhesive.

6. An applicator for applying adhesive to a moving web, the applicator comprising:

a housing having an interior chamber, an inlet in fluid communication with the interior chamber, and a discharge port in fluid communication with the interior chamber; the discharge port having a plurality of cross members defining discrete openings; and a rotor disposed within the interior chamber of the housing, the rotor having a body and a nonlinear channel extending about at least a portion of the body, wherein the body of the rotor comprises a longitudinally extending passage and at least one transverse passage fluidly connecting the longitudinally extending passage to the nonlinear channel, the nonlinear channel being selectively positionable for fluid communication with the inlet and the discharge port of the housing such that adhesive flowing into the housing through the longitudinally extending passage and through the transverse passage flows through and is directed by the nonlinear channel to the discharge port in the housing, the nonlinear channel intersecting the discharge port to bring the nonlinear channel into fluid communication with the discharge port and to define an intersection which allows the adhesive to exit the discharge port at the intersection, the rotor being rotatable relative to the housing to change the position of the intersection in an axial direction.

7. The applicator as set forth in claim 6 wherein the body of the rotor is generally cylindrical and the nonlinear channel is a helical channel extending about at least a portion of a circumference of the cylindrical body.

8. The applicator as set forth in claim 6 wherein the housing includes a selectively detachable end wall for allowing the rotor to be removed from and inserted into the interior chamber of the housing.

9. The applicator as set forth in claim 6 wherein the discrete openings have a width of 0.03 to 0.06 inches, a spacing of 0.01 to 0.03 inches, and an angle of 75 to 105 degrees as measured relative to a longitudinal axis.

10. The applicator as set forth in claim 6 wherein the body of the rotor further comprises at least one return passage in fluid communication with the longitudinally extending passage.

11. The applicator as set forth in claim 6 wherein the rotor is capable of rotating in both a clockwise direction and a counterclockwise direction and is capable of rotating at a constant speed or a variable speed.

* * * * *